US007768466B2

(12) United States Patent
Chi et al.

(10) Patent No.: US 7,768,466 B2
(45) Date of Patent: Aug. 3, 2010

(54) MULTIBAND FOLDED LOOP ANTENNA

(75) Inventors: Yun-Wen Chi, Taipei County (TW); Kin-Lu Wong, Kaohsiung (TW)

(73) Assignee: Acer Incorporated, Taipei Hsien (TW)

( * ) Notice: Subject to any disclaimer, the term of this patent is extended or adjusted under 35 U.S.C. 154(b) by 218 days.

(21) Appl. No.: 12/213,166

(22) Filed: Jun. 16, 2008

(65) Prior Publication Data

US 2009/0256763 A1 Oct. 15, 2009

(30) Foreign Application Priority Data

Apr. 9, 2008 (TW) ..... 97112916 A

(51) Int. Cl.
*H01Q 11/12* (2006.01)

(52) U.S. Cl. ..... 343/741; 343/700 MS

(58) Field of Classification Search ..... 343/700 MS, 343/702, 741, 866, 860
See application file for complete search history.

(56) References Cited

U.S. PATENT DOCUMENTS 6,680,708 B2 * 1/2004 Yamaki ..... 343/741
7,242,364 B2 7/2007 Ranta
7,256,744 B2 * 8/2007 Qi et al. ..... 343/702
2007/0268191 A1 * 11/2007 Ishizuka et al. ..... 343/702
2009/0273530 A1 * 11/2009 Chi et al. ..... 343/741

* cited by examiner

*Primary Examiner*—Tan Ho
(74) *Attorney, Agent, or Firm*—Oliff & Berridge, PLC

(57) ABSTRACT

The present invention relates to a multiband folded loop antenna comprising a dielectric substrate, a ground plane, a radiating portion and a matching circuit. The ground plane is located on the dielectric substrate and has a grounding point. The radiating portion comprises a supporter, a loop strip, and a tuning patch. The loop strip has a length about a half-wavelength of the central frequency of the antenna's first resonant mode. The loop strip has a feeding end and a grounding end, with the grounding end electrically connected to the grounding point on the ground plane. The loop strip is folded into a three-dimensional structure and is supported by the supporter. The tuning patch is electrically connected to the loop strip. The matching circuit is located on the dielectric substrate with one terminal electrically connected to the feeding end of the loop strip and another terminal to a signal source.

15 Claims, 15 Drawing Sheets

8

MULTIBAND FOLDED LOOP ANTENNA

FIELD OF THE INVENTION

The present invention relates to a loop antenna, and more particularly to a multiband folded loop antenna suitable to be embedded in a mobile phone.

BACKGROUND OF THE INVENTION

With the fast development in wireless communication technologies, the antenna plays an increasingly important role in various kinds of wireless communication products. Particularly, due to the tendency of developing lightweight and compact wireless communication products, the antenna size, particularly the antenna height, would decide the value of wireless communication products. However, taking the embedded mobile phone antenna as an example, while the space inside the mobile phone allowed for the antenna is much limited than ever before, the antenna still is required to cover multiband operation in order to meet the actual demands in the wireless communication system. It has been found that the loop antenna is more suitable to be internal mobile phone antenna compared to the conventional monopole antenna or PIFA antenna. This is because the loop antenna may be formed by bending and winding a thin metal wire. Unlike the conventional monopole antenna or PIFA antenna that relies on wide metal strip to increase the bandwidth, the bandwidth of the loop antenna is almost not decreased when the thin metal wire with a small wire thickness is used. Therefore, the loop antenna may have a relatively small size while achieves the same multiband operation as the conventional mobile phone antenna.

However, the lower band of the loop antenna with a greatly reduced size can cover GSM850 or GSM900 operation, but has difficulty in simultaneously covering GSM850/900 dual-band operation. Therefore, it is necessary to develop the technique for increasing the bandwidth of the loop antenna. U.S. Pat. No. 7,242,364 B2 entitled "Dual-Resonant Antenna" discloses a technique of applying a matching circuit for the internal mobile phone antenna used in the mobile communication system, so that the single-resonant mode of the antenna can have the dual-resonant characteristic to achieve the purpose of increasing the bandwidth of the antenna. However, U.S. Pat. No. 7,242,364 B2 only teaches the application of the above technique for the internal mobile phone antenna for single-band operation, but such a technique could not be directly applied to a dual-band (such as 900 and 1800 MHz) mobile phone antenna. Meanwhile, such a technique is only applicable to the mobile phone antenna having a length about a quarter-wavelength of the resonant frequency of the antenna.

To solve the above problem, a multiband folded loop antenna is developed, in which a metal strip is bent into a loop and then folded into a three-dimensional structure occupying a small volume. With respect to the operating technique of the folded loop antenna, the 0.5-wavelength resonant mode of the loop strip is used for the lower band of the antenna, and the higher-order resonant modes of the loop strip are formed into a wide upper band. Besides, a matching circuit is further used in the proposed antenna for the lower band to have a dual-resonant characteristic and increase the bandwidth. Besides, at least one tuning patch is further used in the antenna to improve the impedance matching over the upper band. With the above arrangements, the antenna is capable of providing five-band operation covering GSM850/900/1800/1900/UMTS bands and meeting the requirement of being applied to mobile phone systems.

SUMMARY OF THE INVENTION

One of objectives of the present invention is to provide a novel antenna for the mobile phone, such an antenna not only provides five-band operation covering GSM850 (824~894 MHz), GSM900 (890~960 MHz), GSM1800 (1710~1880 MHz), GSM1900 (1850~1990 MHz), and UMTS (1920~2170 MHz) bands, but also has a size smaller than that of the conventional mobile phone antennas covering the same operating band.

Besides, another objective of the present invention is to provide a novel antenna for the mobile phone, such an antenna has the advantages of having simple structure and definite operating mechanism, easy manufacturing, and saving space in a mobile phone.

To achieve the above and other objects, the antenna in accordance with the present invention comprises a dielectric substrate, a ground plane, a radiating portion, and a matching circuit. The ground plane has a grounding point and is located on the dielectric substance. The radiating portion comprises a supporter, a loop strip, and a tuning patch. The loop strip of the radiating portion has a length about a half-wavelength of the central frequency of the antenna's first resonant mode, and has a feeding end and a grounding end, with the grounding end electrically connected to the grounding point of the ground plane. The loop strip is folded into a three-dimensional structure and supported by the supporter. The tuning patch of the radiating portion is electrically connected to the loop strip. The matching circuit is located on the dielectric substrate, and has one terminal electrically connected to the feeding end of the loop strip and another terminal connected to a signal source.

Preferably, the dielectric substrate can be a system circuit board of a mobile communication apparatus.

Preferably, the ground plane can be a system ground plane of a mobile communication apparatus.

Preferably, the ground plane is formed on the dielectric substrate by printing or etching.

Preferably, the material of the supporter can be air, a dielectric substrate, a plastic material, or a ceramic material.

Preferably, the matching circuit further comprises at least one capacitive element and at least one inductive element.

In the present invention, the 0.5-wavelength resonant mode of the loop strip is used for the lower band of the antenna, and the loop strip's higher-order resonant modes are used for the upper band of the antenna. Further, the matching circuit is used to make the antenna's first resonant mode to be dual-resonant and hence to increase the bandwidth of the lower band, and at least one tuning patch is used to improve the impedance matching over the upper band. The lower band of antenna has a bandwidth of about 200 MHz from 810 to 1010 MHz to cover GSM850/900 band operation (from 824 to 960 MHz). Moreover, the impedance matching of the antenna of the present invention over the lower band is always higher than 6 dB. Meanwhile, the upper band of antenna is provided with a bandwidth of about 615 MHz from 1635 to 2250 MHz to cover GSM1800/1900/UMTS band operation (from 1710 to 2170 MHz), and the return loss of the antenna of the present invention over the upper band is also always higher than 6 dB to meet the application requirement. Meanwhile, the antenna of the present invention has simplified structure, definite operating mechanism, and an antenna size smaller than that of other mobile phone antennas covering the same band operation. That is, the antenna of the present invention may save the space for mounting the antenna in the mobile phone while maintains the multiband antenna characteristic. Therefore, the antenna of the present invention is greatly valuable in terms of its wide industrial applications.

BRIEF DESCRIPTION OF THE DRAWINGS

The structure and the technical means adopted by the present invention to achieve the above and other objects can be best understood by referring to the following detailed description of the embodiments and the accompanying drawings, wherein.

DETAILED DESCRIPTION OF THE EMBODIMENTS

Figure 1A:
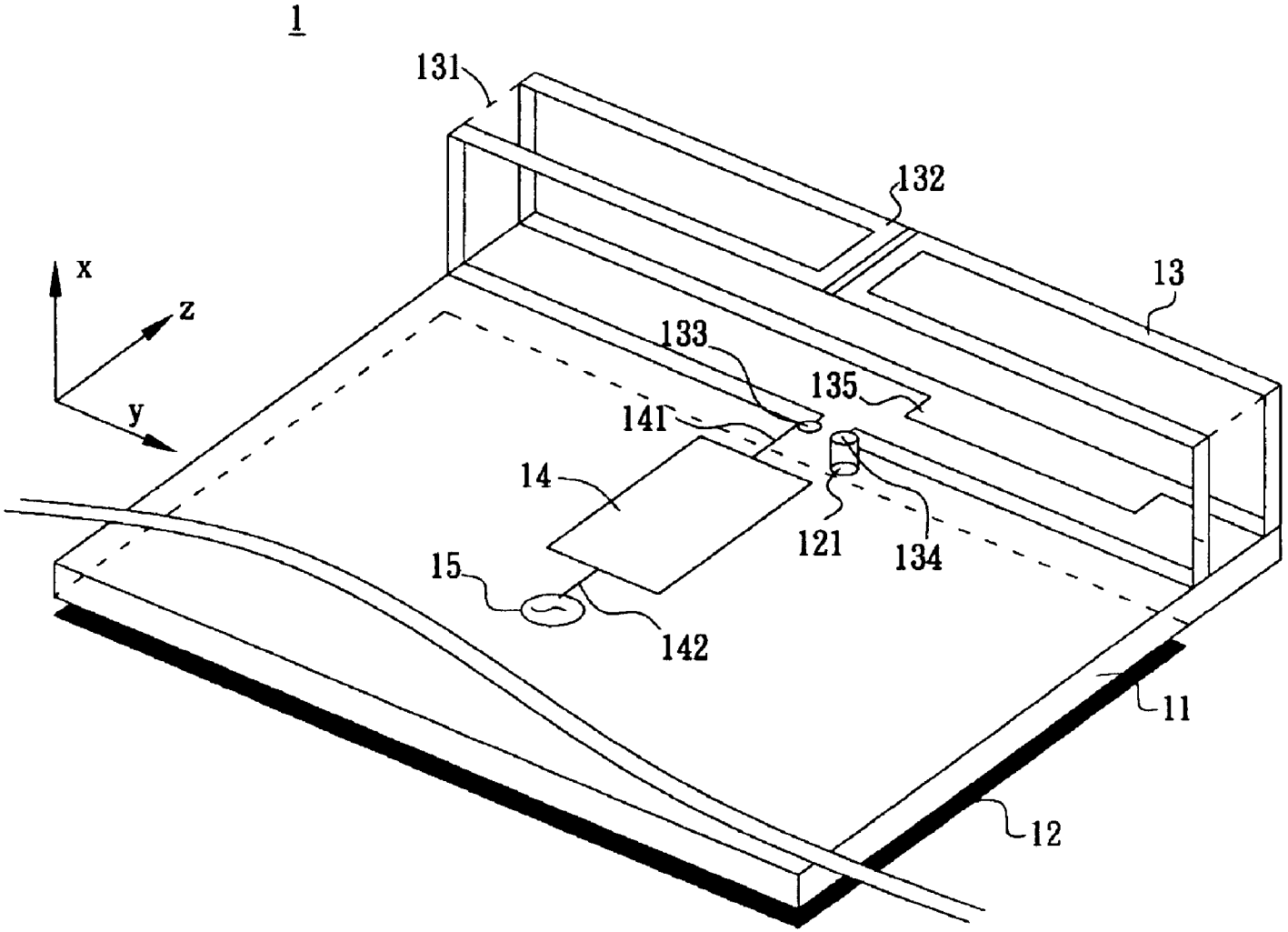
FIG. 1 illustrates the structure of a multiband folded loop antenna according to a first embodiment of the present invention, wherein FIG. 1(*a*) illustrates the antenna structure, and FIG. 1(*b*) illustrates a circuit diagram of a matching circuit connected to the antenna.
Figure 1B:
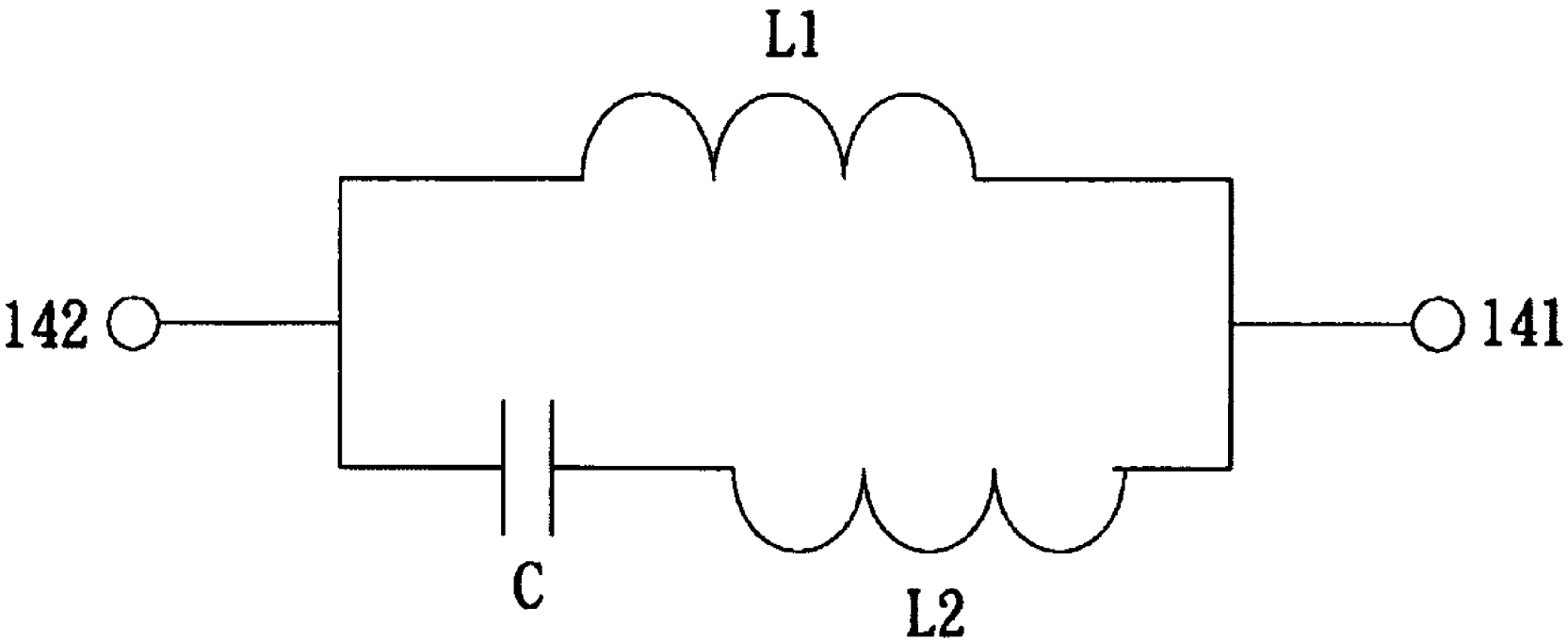

FIG. 1 illustrates the structure of a multiband folded loop antenna according to a first embodiment of the present invention, wherein FIG. 1(*a*) illustrates the antenna structure, and FIG. 1(*b*) illustrates a circuit diagram of a matching circuit connected to the antenna. The antenna 1 according to the first embodiment of the present invention comprises a dielectric substrate 11, a ground plane 12, a radiating portion 13, and a matching circuit 14. The ground plane 12 has a grounding point 121, and is located on the dielectric substrate 11. The radiating portion 13 comprises a supporter 131, a loop strip 132, and a tuning patch 135. The loop strip 132 of the radiating portion 13 has a length about a half-wavelength the central frequency of the first resonant mode of the antenna, and has a feeding end 133 and a grounding end 134 which is electrically connected to the grounding point 121 of the ground plane 12. The loop strip 132 is folded into a three-dimensional structure and is supported by the supporter 131. The tuning patch 135 of the radiating portion 13 is electrically connected to the loop strip 132. The matching circuit 14 is located on the dielectric substrate 11 with one terminal 141 electrically connected to the feeding end 133 of the loop strip 132 and another terminal 142 connected to a signal source 15.

Preferably, the dielectric substrate 11 can be a system circuit board of a mobile communication apparatus, and the ground plane 12 can be a system ground plane of a mobile communication apparatus. Preferably, the ground plane 12 can be formed on the dielectric substrate 11 by printing or etching. The matching circuit 14 further comprises at least one capacitive element and at least one inductive element.

For example, as shown in FIG. 1(*b*), the embodiment of matching circuit 14 comprises one capacitive element and two inductive elements. The capacitive element C and inductive element L2 are connected in series and then further connected to the inductive element L1 in parallel. Preferably, the capacitive element C may further comprise two serially connected capacitive elements.

Figure 2:
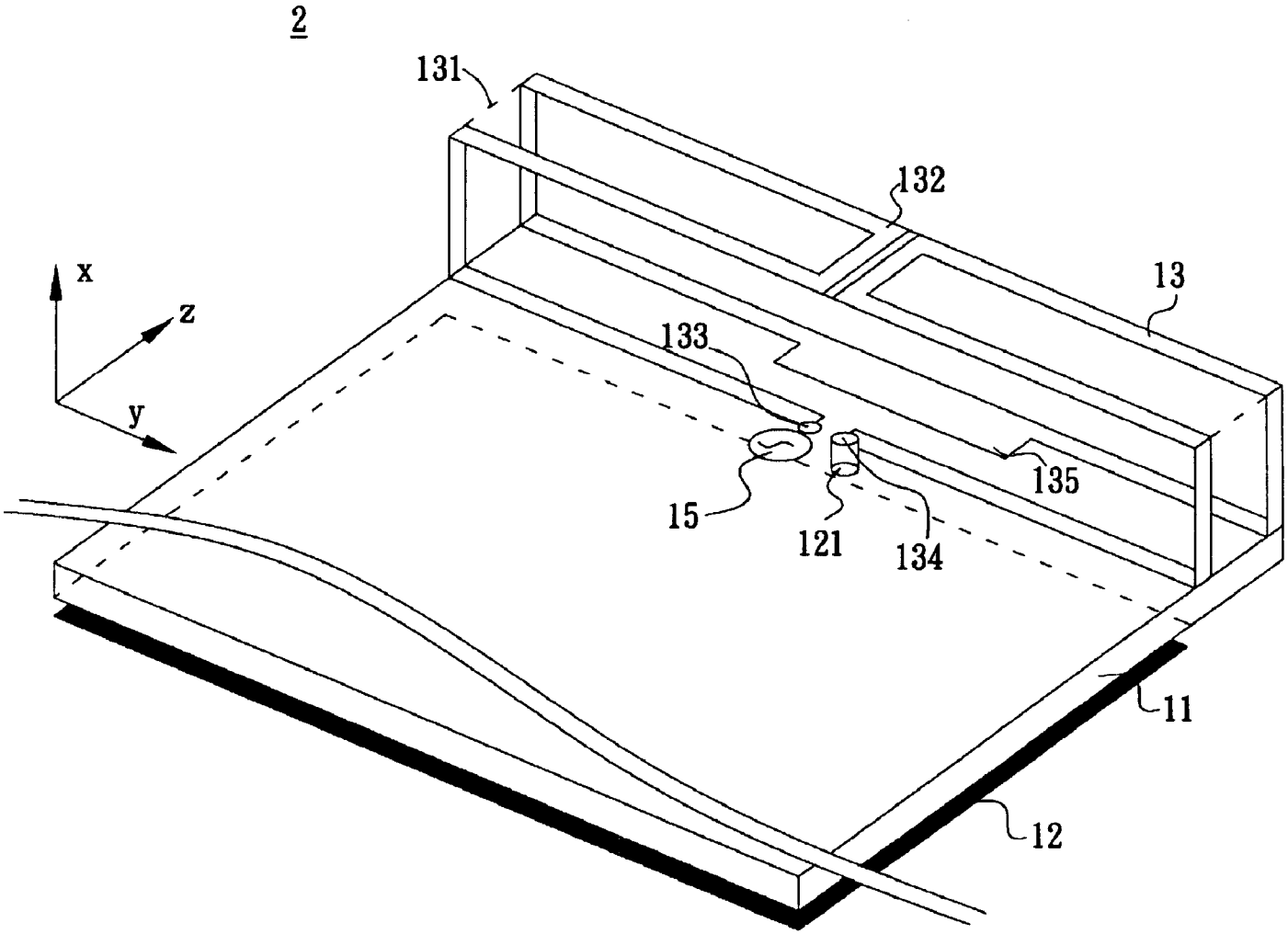
FIG. 2 illustrates the structure of a multiband folded loop antenna according to a second embodiment of the present invention.

FIG. 2 illustrates a multiband folded loop antenna 2 according to a second embodiment of the present invention. The antenna 2 comprises a dielectric substrate 11, a ground plane 12, and a radiating portion 13. The ground plane 12 has a grounding point 121, and is located on the dielectric substrate 11. The radiating portion 13 comprises a supporter 131, a loop strip 132, and a tuning patch 135. The loop strip 132 of the radiating portion 13 has a length about a half-wavelength of the central frequency of the first resonant mode of the antenna, and has a feeding end 133 and a grounding end 134. The feeding end 133 is electrically connected to a signal source 15, and the grounding end 134 is electrically connected to the grounding point 121 of the ground plane 12. The loop strip 132 is folded into a three-dimensional structure and supported by the supporter 131. The tuning patch 135 of the radiating portion 13 is electrically connected to the loop strip 132.

Preferably, the dielectric substrate 11 can be a system circuit board of a mobile communication apparatus, and the ground plane 12 can be a system ground plane of a mobile communication apparatus. Preferably, the ground plane 12 can be formed on the dielectric substrate 11 by printing or etching.

Figure 3:
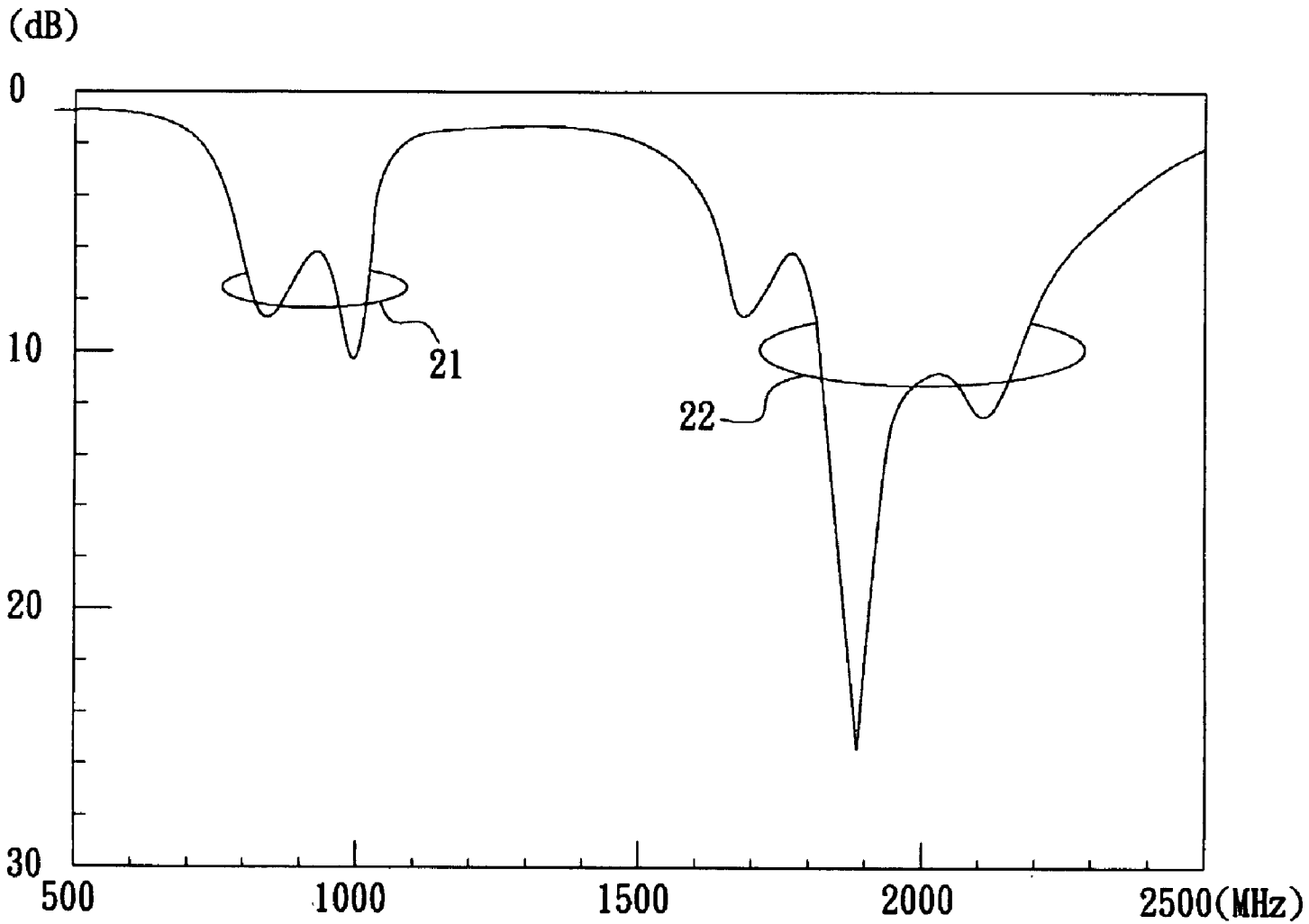
FIG. 3 is a graph illustrating the measured return loss of the antenna according to the first embodiment of the present invention.

FIG. 3 illustrates the measured result of return loss of the antenna according to the first embodiment of the present invention. The antenna used in the experiment has the following sizes and element values: the dielectric substrate 11 is an FR4 dielectric substrate having a thickness of 0.8 mm; the ground plane 12 is 40×100 $mm^2$ in size and is formed on the surface of the dielectric substrate 11 by etching. The supporter 131 for the radiating portion 13 is air, that is, the radiating portion 13 in the first embodiment 1 is a hollow structure having a volume as small as 40×3×5 $mm^3$ or 0.6 $cm^3$, and the loop strip 132 surrounds around an outer surface of the supporter 131. The total length of the loop strip 132 is about 180 mm, which is about a half-wavelength of the central frequency of the first resonant mode of the antenna. The loop strip 132 has a feeding end 133 and a grounding end 134 which is electrically connected to the grounding point 121 of the ground plane 12. As having been mentioned above, the loop strip 132 is folded into a three-dimensional structure to enclose the supporter 131 therein. The tuning patch 135 of the radiating portion 13 has a size of 16×1.3 $mm^2$, and is electrically connected to the loop strip 132. The matching circuit 14 is located on the dielectric substrate 11 with one terminal 141 electrically connected to the feeding end 133 of the loop strip 132 of the radiating portion 13, and another terminal 142 connected to a signal source 15. The value chosen for the capacitive element C of the matching circuit 14 is 1.0 pF, and the value chosen for the inductive element L2 is 9.1 nH, and the value chosen for the inductive element L1 is 4.3 nH. As mentioned above, the loop strip 132 used in the experiment is 180 mm in length, which is about a half-wavelength at 900 MHz. Therefore, as illustrated in FIG. 3, the half-wavelength resonant mode of the antenna 1 is used for the lower band 21, and the higher-order resonant modes of the antenna 1 are formed into the upper band 22, wherein the resonant modes for the upper band 22 is mainly the one-wavelength resonant mode and the 1.5-wavelength resonant mode of the loop strip 132. The technique adopted by the present invention has two characteristics: the use of the matching circuit 14 to increase a zero of the imaginary part of the input impedance in the lower band 21, so that the resonant mode of the lower band 21 has a dual-resonant characteristic and accordingly shows an increased bandwidth; and the use of the tuning patch 135 to improve the impedance matching over the upper band 22. In a situation in which the matching circuit 14 is not used, the bandwidth of the 0.5-wavelength resonant mode of the loop strip 132 can not cover both GSM850/900 operating bandwidths. The tuning patch 135 is used to tune the impedance matching of the upper band, so that the upper band can cover all GSM1800/1900/UMTS operating bands. Meanwhile, the matching circuit 14 is capable of increasing the bandwidth of the lower band without affecting the upper band 22. In the experiment conducted on the antenna according to the first embodiment of the present invention, the matching circuit 14 is a band-reject circuit with a 3-dB bandwidth of 170 MHz only, and a central resonant frequency of about 1100 MHz. The matching circuit 14 has a dramatically varied real-part input impedance and imaginary-part input impedance at its central resonant frequency. The variation in the imaginary-part input impedance is helpful in increasing a zero of the imaginary-part input impedance to the 0.5-wavelength resonant mode of the loop strip 132, so that the lower band 21 may have the dual-resonant to achieve the wide operating band covering GSM850/900 operation. Meanwhile, since the matching circuit 14 has been designed to have a band-rejection central frequency of about 1100 MHz, it has little influence on the upper band 22. As observed from the measured result of return loss, the lower band 21 of the antenna of the present invention is of a 0.5-wavelength resonant mode with a dual-resonant characteristic, and provides an operating bandwidth of about 200 MHz (from 810 to 1010 MHz) for covering both GSM850/900 operating bands, and the impedance matching of the antenna 1 within this lower band is always higher than 6 dB. On the other hand, the upper band 22 of the antenna of the present invention provides an operating bandwidth of about 615 MHz (from 1635 to 2250 MHz) for covering GSM1800/1900/UMTS operating bands, and the return loss within this upper band is also higher than 6 dB to satisfy the application requirements.

The antenna 2 according to the second embodiment of the present invention as shown in FIG. 2 is different from the antenna 1 shown in FIG. 1 in that the radiating portion 13 of the antenna 2 has a size of $40\times5\times6$ mm$^3$ or 1.2 cm$^3$, which is larger than the radiating portion 13 in the antenna 1. To produce this larger antenna 2, a manufacturer needs only to change the position at where the tuning patch 135 is electrically connected to the loop strip 132 to achieve the operation covering all GSM850/900/1800/1900/UMTS bands. This means whether to use the matching circuit 14 depends on the size and space occupied by the antenna. When the antenna has a volume so reduced that the lower band of the antenna fails to cover both GSM850/900 bands, the use of the matching circuit 14 as in the antenna 1 of the present invention would enable the lower band to have the dual-resonant phenomenon and, accordingly, an increased bandwidth to cover the required operating band.

Figure 4A:
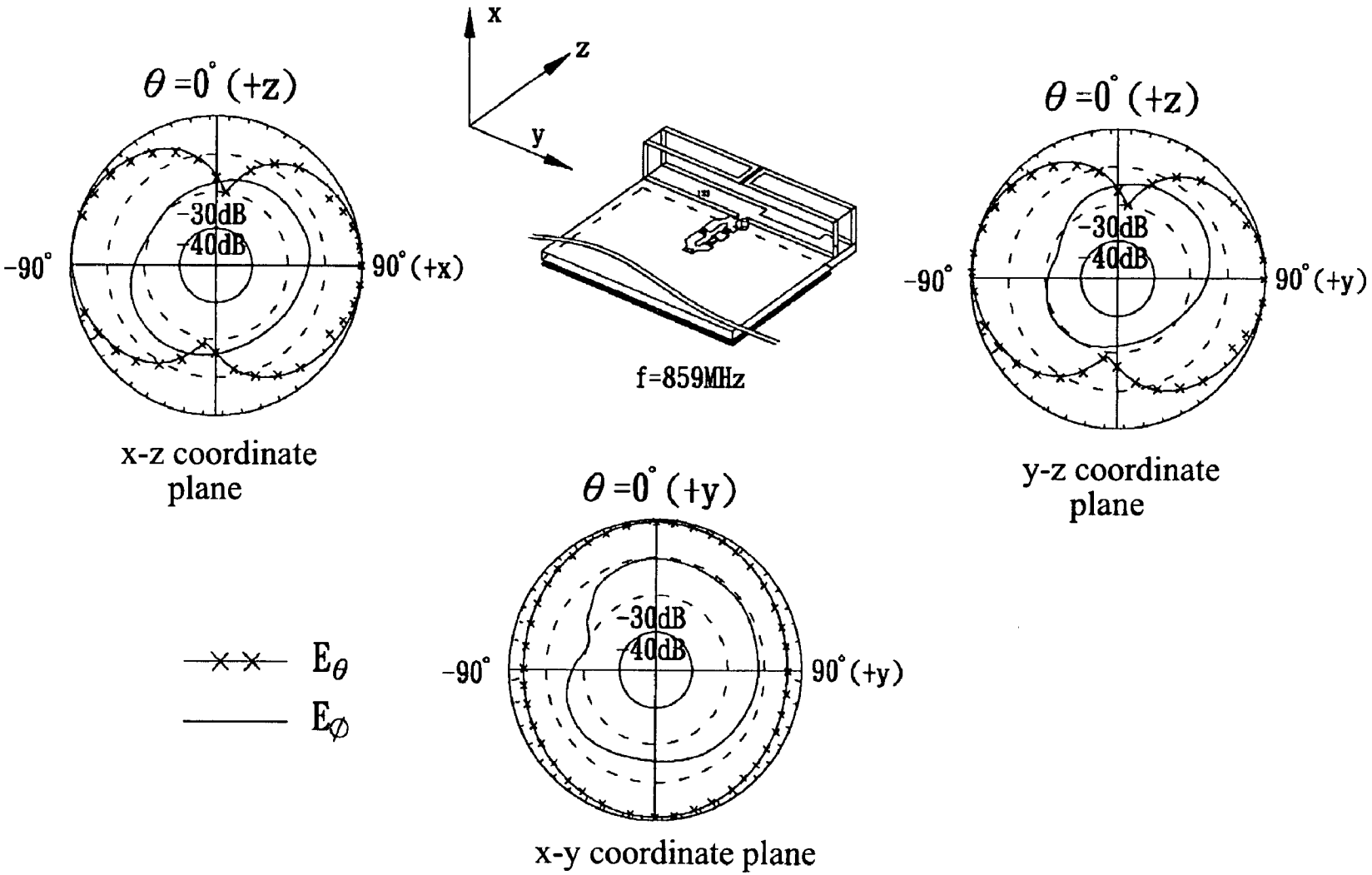
FIG. 4 illustrates the radiation patterns of the antenna according to the first embodiment of the present invention when providing operation covering GSM850/900 bands; wherein FIG. 4(*a*) illustrates the radiation patterns at 859 MHz and FIG. 4(*b*) illustrates the radiation patterns at 925 MHz.
Figure 4B:
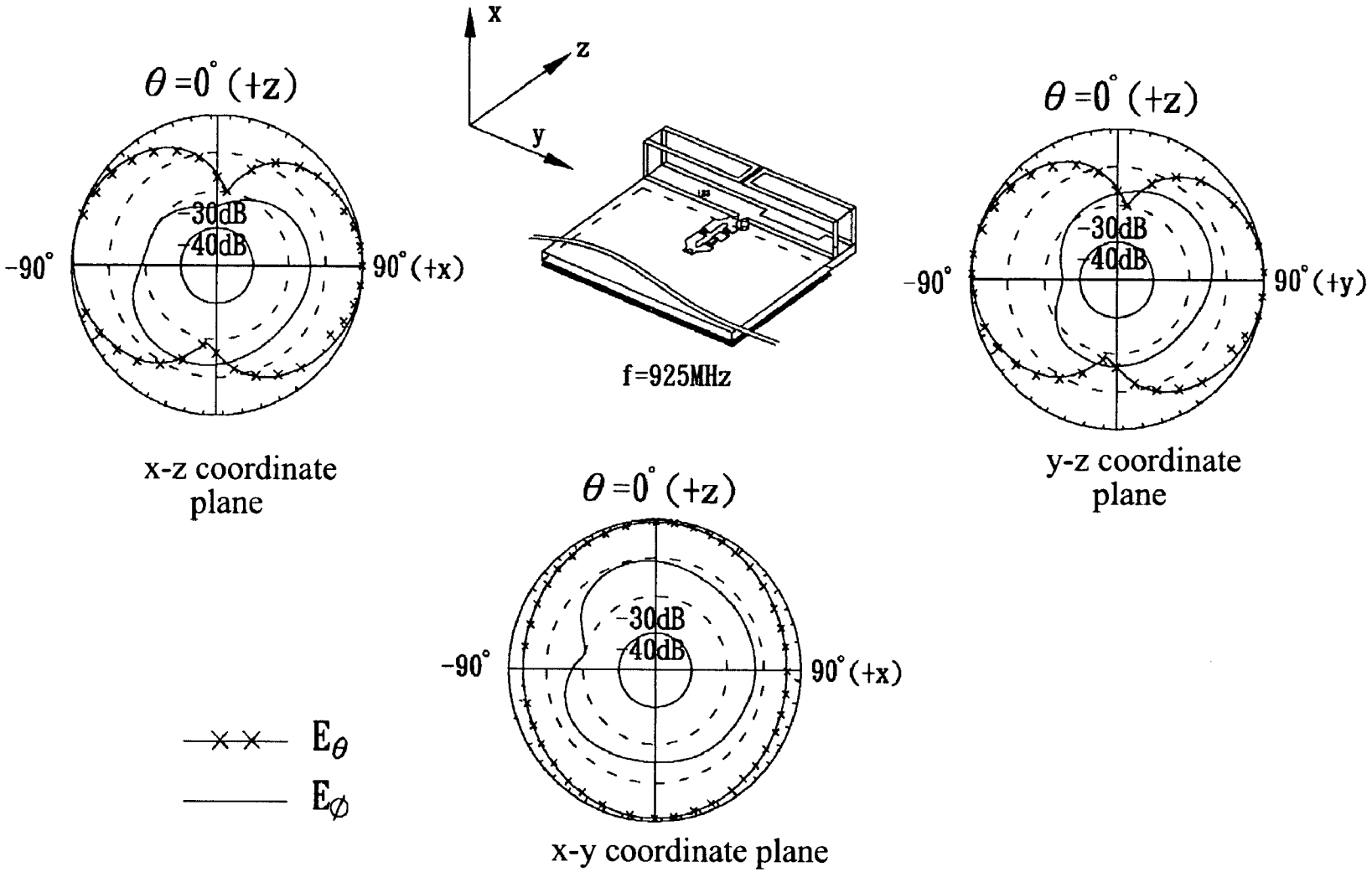

FIG. 4 illustrates the radiation patterns of the antenna 1 according to the first embodiment of the present invention when providing operation covering GSM850/900 bands, wherein FIG. 4(*a*) illustrates the radiation patterns at 859 MHz and FIG. 4(*b*) illustrates the radiation patterns at 925 MHz. The lower band 21 of the antenna 1 covering these operating bands is the 0.5-wavelength resonant mode. As shown in FIG. 4, the radiation patterns of the 0.5-wavelength resonant mode resonating on the loop strip is similar to the radiation patterns of the conventional monopole antenna or PIFA antenna resonating at the same frequencies.

Figure 5A:
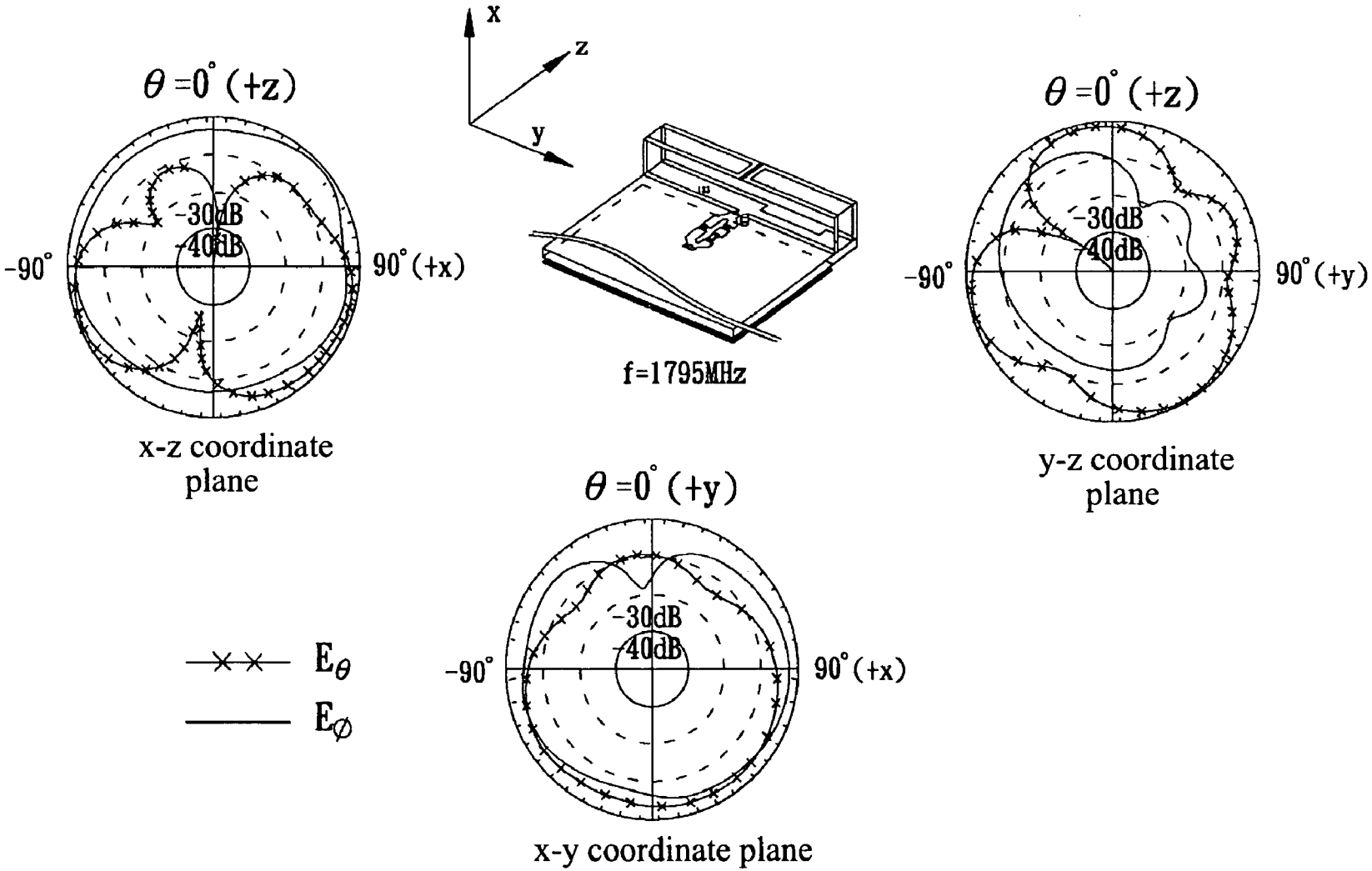
FIG. 5 illustrates the radiation patterns of the antenna according to the first embodiment of the present invention when providing operation covering GSM1800/1900/UMTS bands; wherein FIG. 5(*a*) illustrates the radiation patterns at 1795 MHz, FIG. 5(*b*) illustrates the radiation patterns at 1920 MHz, and FIG. 5(*c*) illustrates the radiation patterns at 2045 MHz.
Figure 5B:
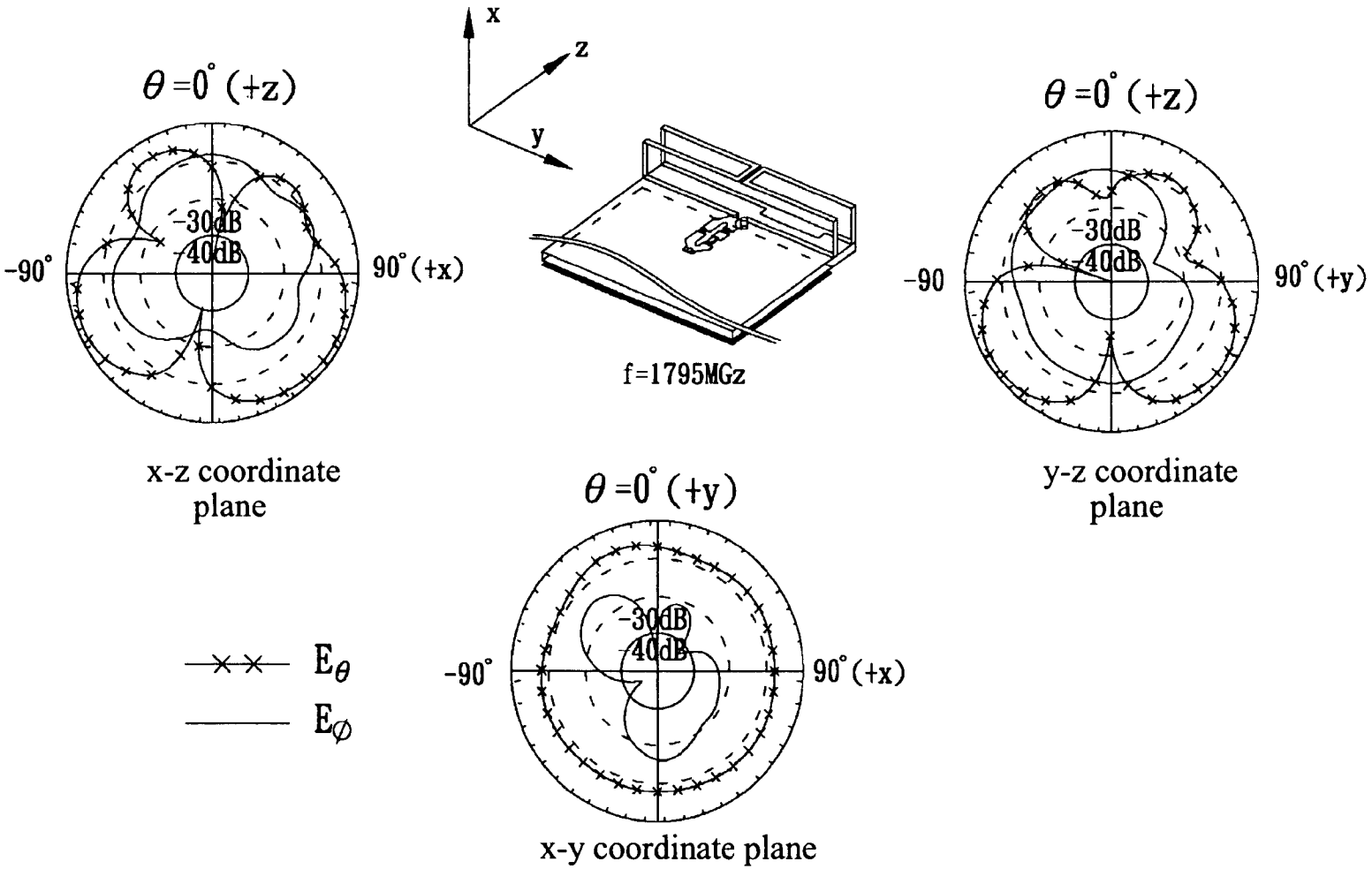
Figure 5C:
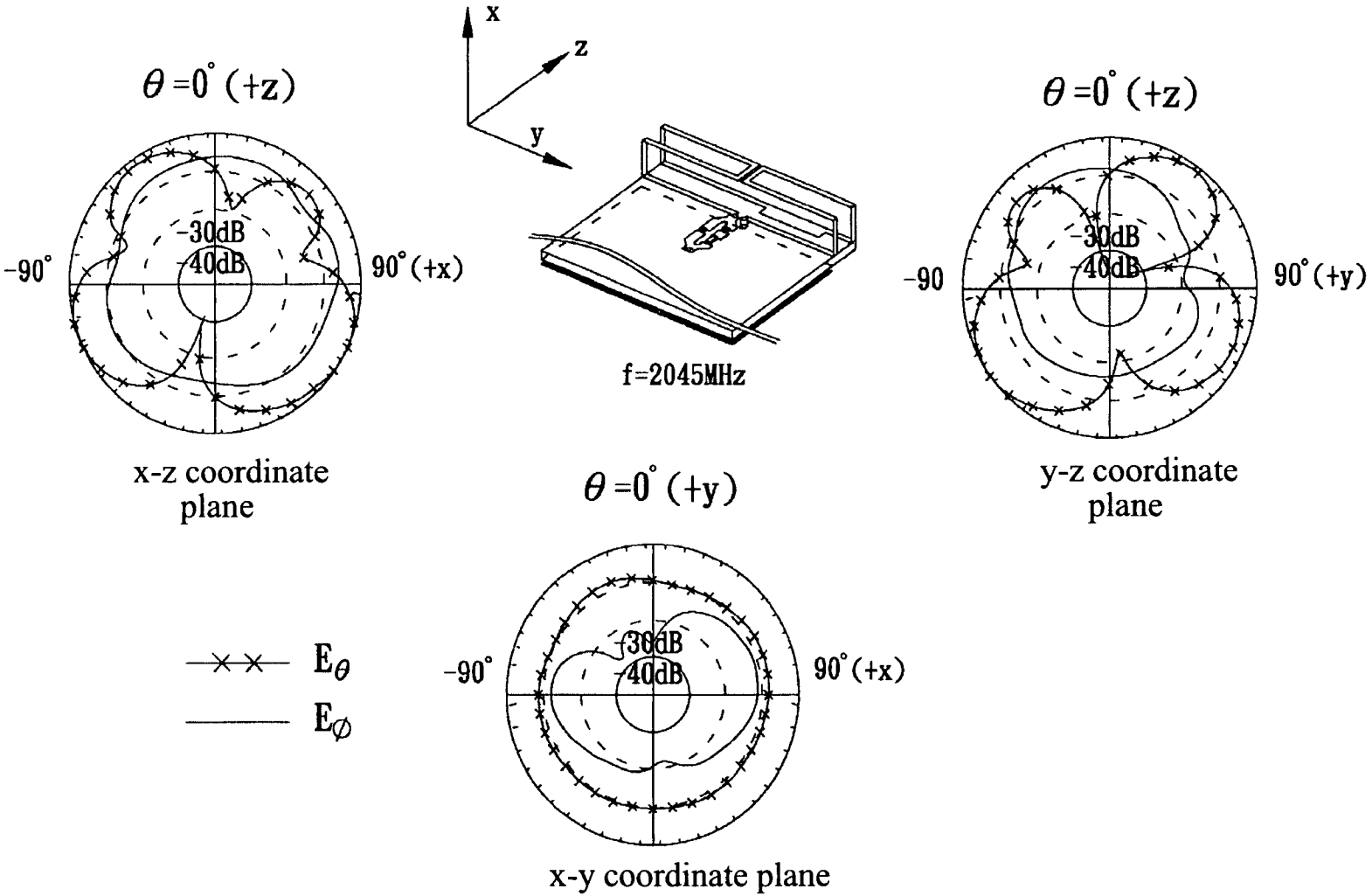

FIG. 5 illustrates the radiation patterns of the antenna 1 according to the first embodiment of the present invention when providing operation covering GSM1800/1900/UMTS bands, and FIG. 5(*a*) illustrates the radiation patterns at 1795 MHz, FIG. 5(*b*) illustrates the radiation patterns at 1920 MHz, and FIG. 5(*c*) illustrates the radiation patterns at 2045 MHz. The upper band 22 of the antenna 1 covering these operating bands is formed by the one-wavelength resonant mode and the 1.5-wavelength resonant mode of the antenna. As shown in FIG. 5, the radiation patterns within the upper band 22, as being affected by the current zero on the ground plane, have more variations in the radiation patterns in the x-z and y-z planes compared to the radiation patterns within the lower band 21. However, such variations do not affect the practical application of the antenna 1.

Figure 6A:
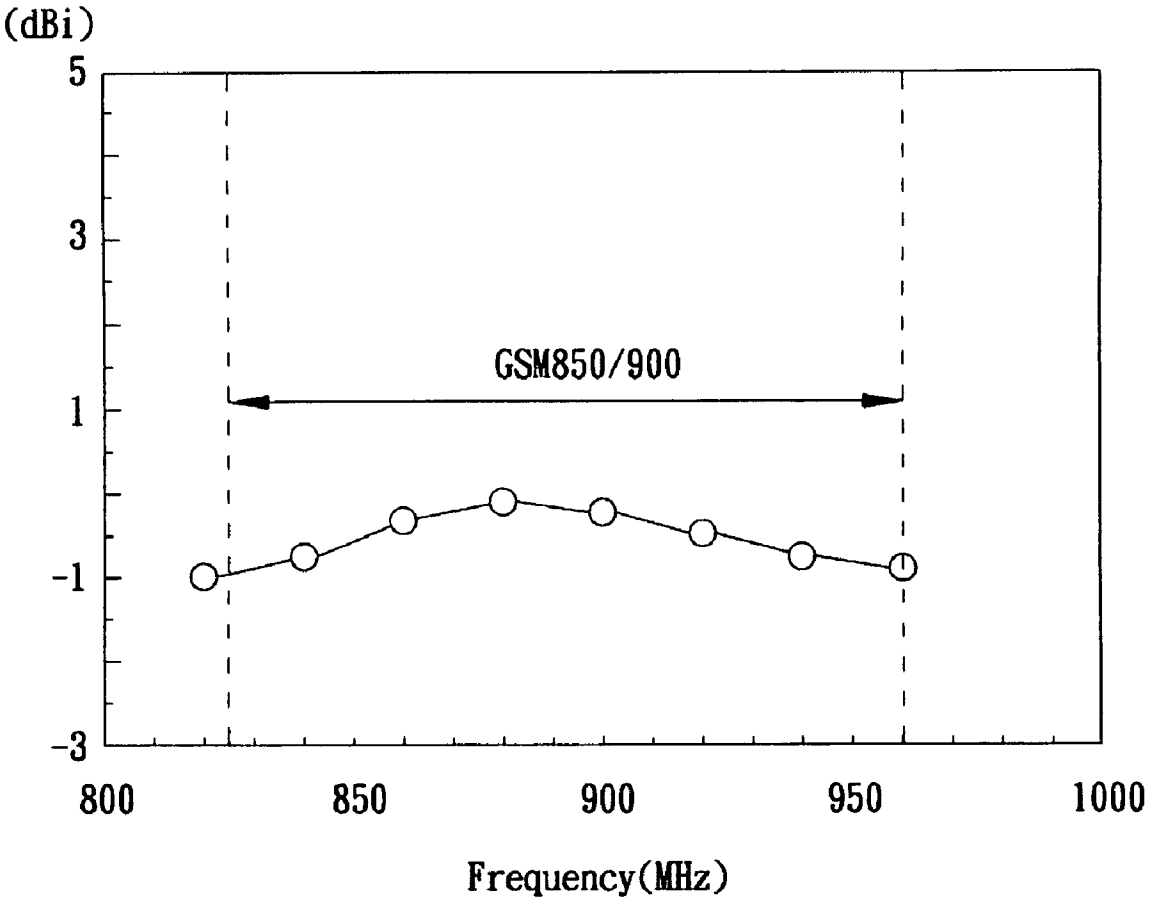
FIG. 6 illustrates the antenna gain graphs of the antenna according to the first embodiment of the present invention in different band operations; wherein FIG. 6(*a*) illustrates the antenna gain graph when providing operation covering GSM850/900 bands, and FIG. 6(*b*) illustrates the antenna gain when providing operation covering GSM1800/1900/UMTS bands.
Figure 6B:
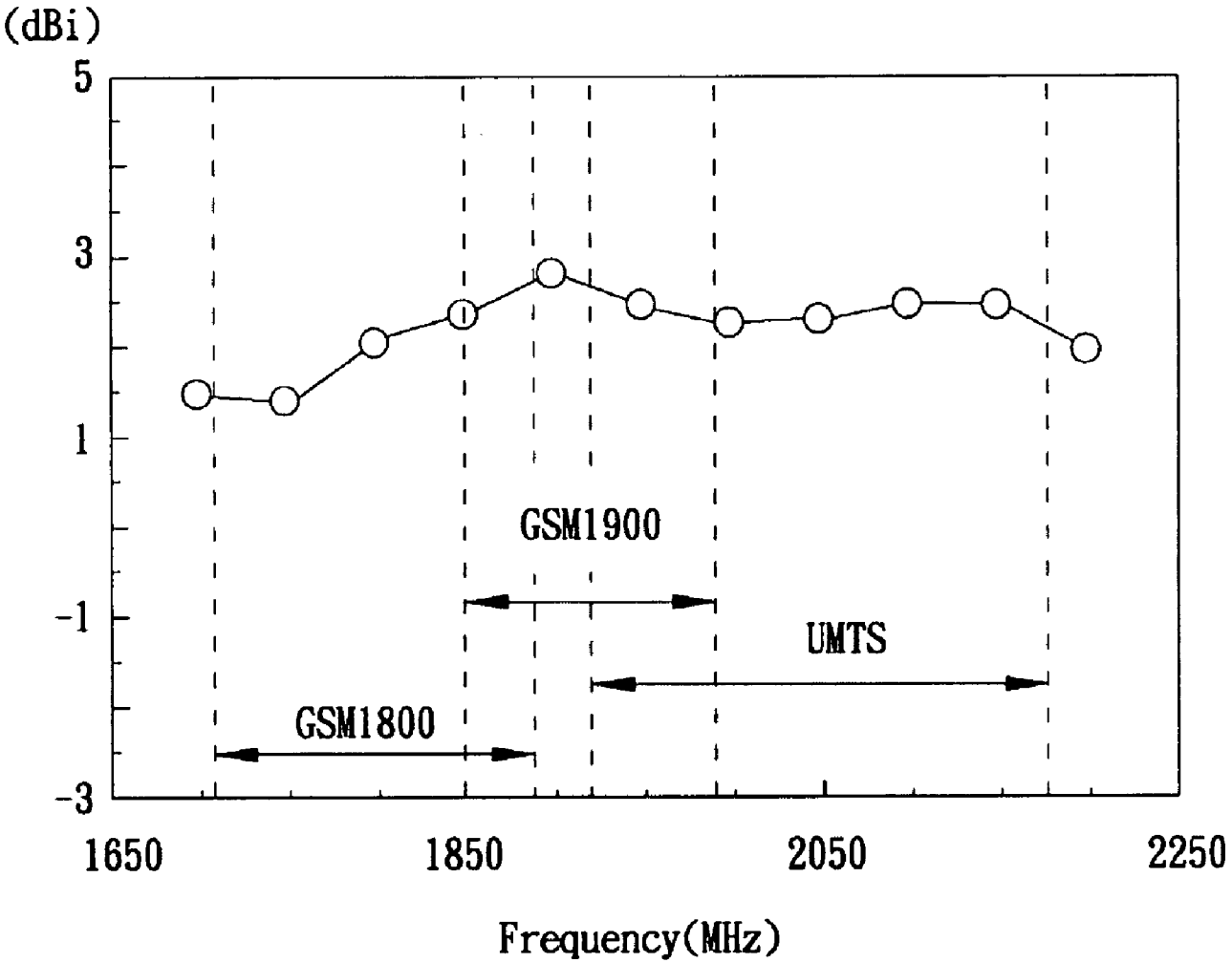
Figure 7:
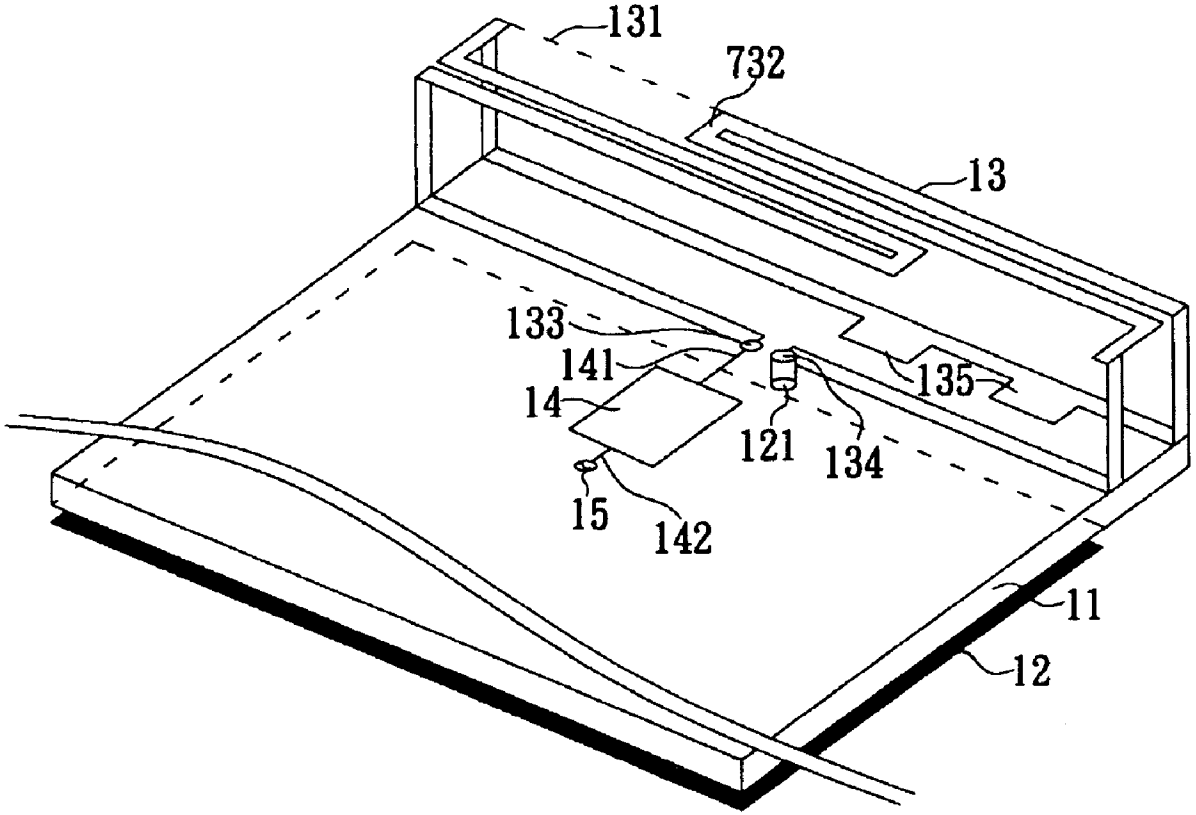
FIGS. 7 to 10 respectively illustrate a first, a second, a third, and a fourth derived embodiment of the multiband folded loop antenna according to the present invention.
Figure 8:
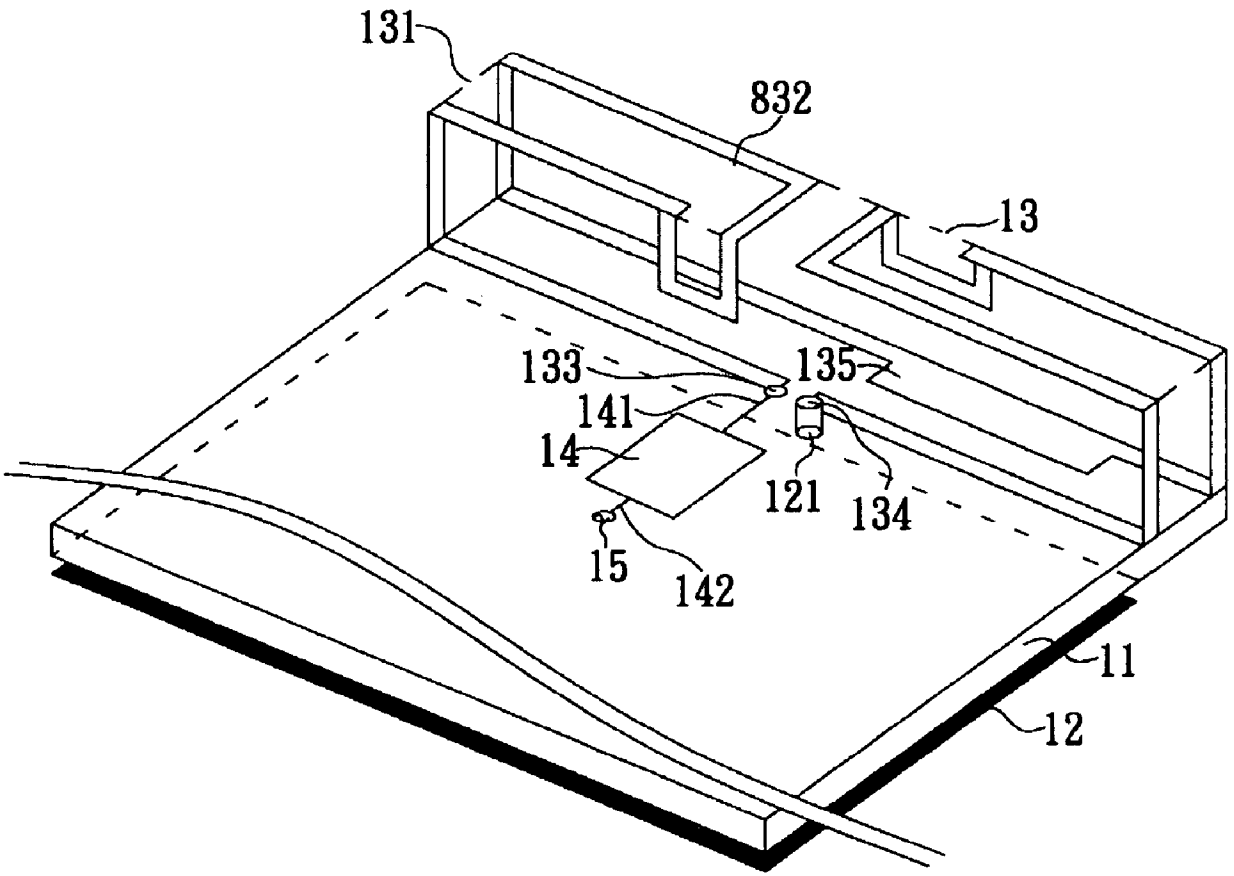
Figure 9:
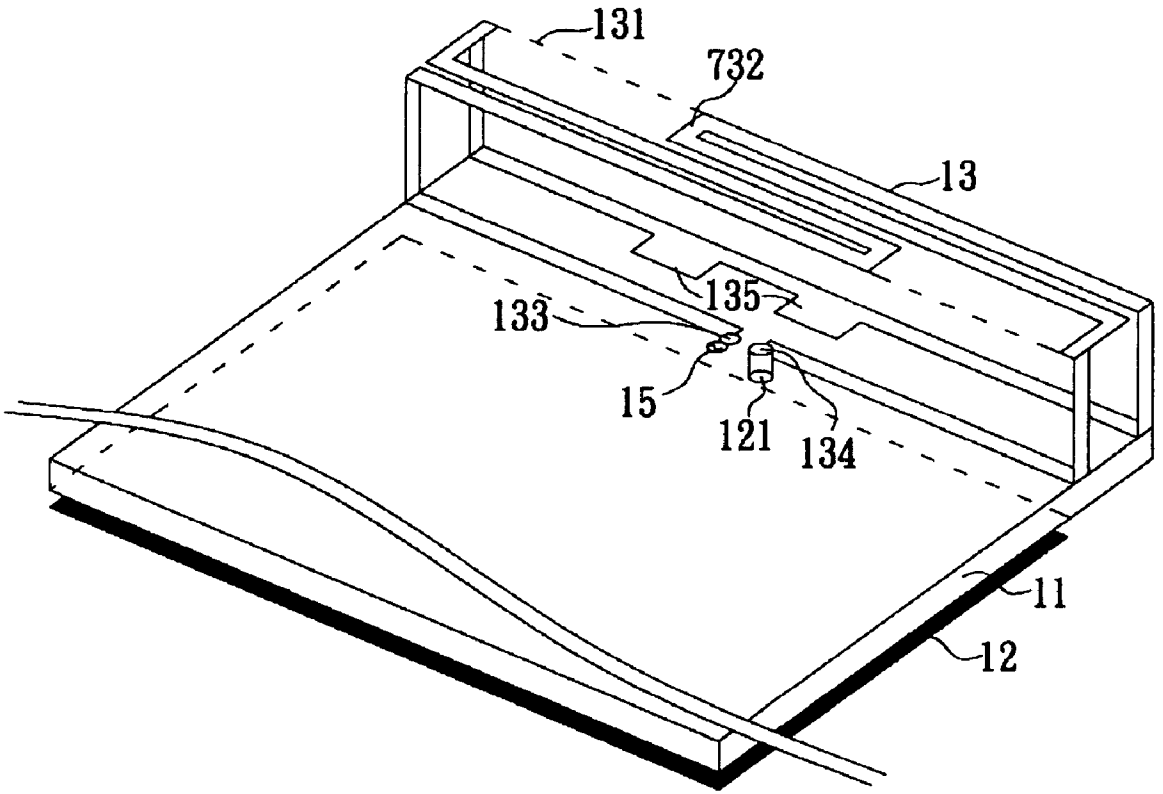
Figure 10:
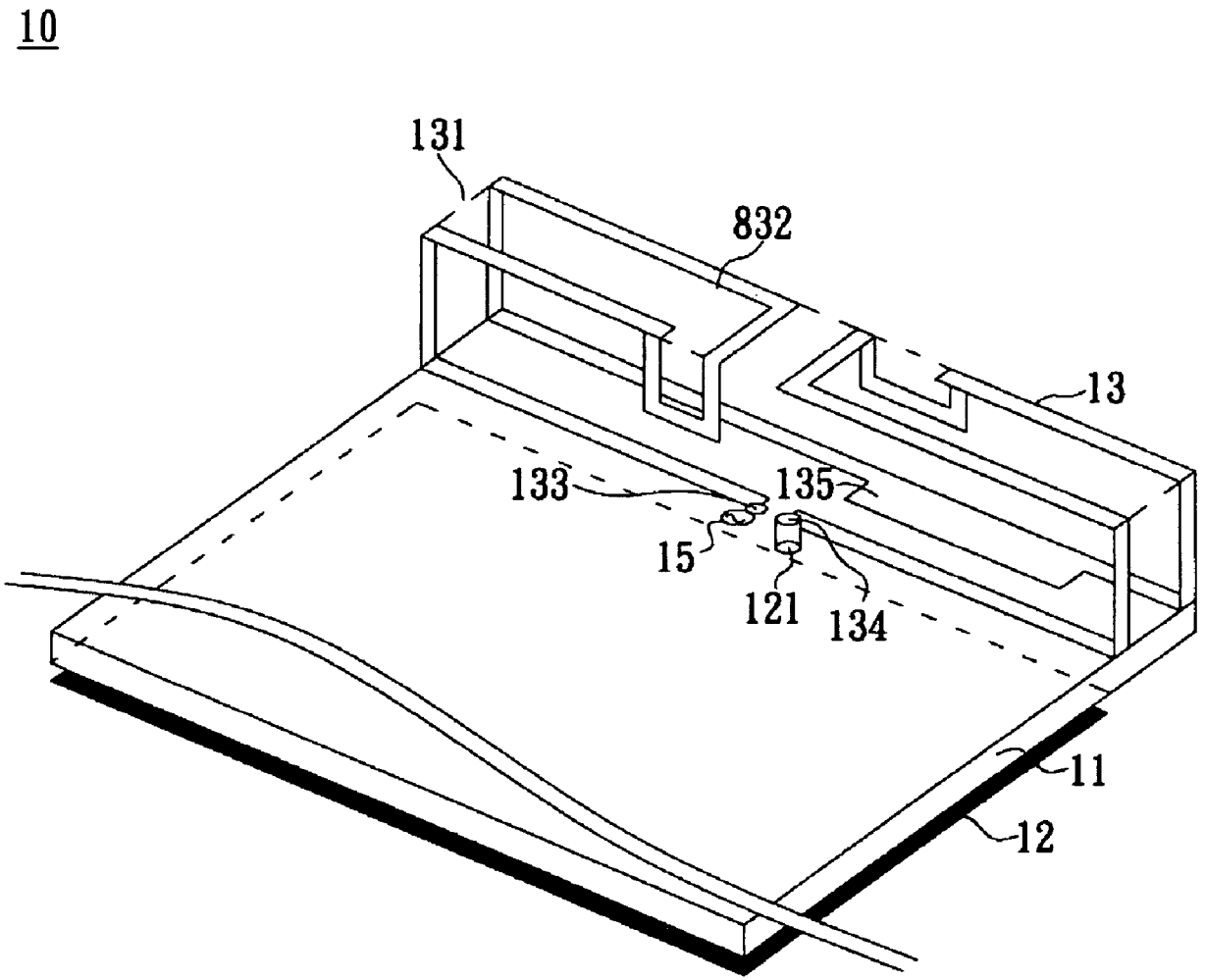

FIG. 6 illustrates the antenna gain graphs of the antenna 1 according to the first embodiment of the present invention in different operation bands, wherein FIG. 6(*a*) illustrates the antenna gain in GSM850/900 bands, and FIG. 6(*b*) illustrates the antenna gain graph in GSM1800/1900/UMTS bands. As shown in the figure, the antenna gain of the present invention is from about −1.0 to about −0.1 dBi in GSM850/900 bands, and from about 1.7 to about 2.6 dBi in GSM1800/1900/UMTS bands, and all meeting the requirement in practical applications.

FIGS. 7, 8, 9, and 10 respectively illustrate the antenna 7, 8, 9, 10 according to the second, the third, the fourth, and the fifth derived embodiments of the present invention. The structures of antennas 7 and 8 according to the second and third derived embodiments of the present invention are substantially similar to the antenna 1 according to the first embodiment, and the structures of the antennas 9 and 10 according to the fourth and fifth derived embodiments are substantially similar to the antenna 2 according to the second embodiment, except that the loop strips 732 and 832 for the antennas 7, 9 and the antennas 8, 10, respectively, are folded in manners different from the loop strips 132 for the antennas 1, 2. The antennas 7 and 9 have two tuning patches 135. However, all the four derived embodiments of the present invention are able to achieve the same function as the two embodiments.

The results from the experiment conducted on the antenna of the present invention indicate that the antenna of the present invention is suitable for use as a mobile phone antenna to cover all the five GSM850/900/1800/1900/UMTS bands. The lower band 21 covering GSM850/900 bands has a bandwidth of about 200 MHz from 810 to 1010 MHz, and the upper band 22 covering GSM1800/1900/UMTS bands has a bandwidth of about 615 MHz from 1635 to 2250 MHz, and both lower band 21 and upper band 22 meet the application requirements for using with mobile phone systems.

In brief, the antenna according to the present invention has simplified structure, definite operating mechanism, low manufacturing cost, and reduced antenna size while maintains the multiband antenna characteristic. Therefore, the antenna of the present invention is highly valuable in terms of its wide industrial applications.

The present invention has been described with some embodiments thereof and it is understood that many changes and modifications in the described embodiments can be carried out without departing from the scope and the spirit of the invention that is intended to be limited only by the appended claims.

What is claimed is:

1. A multiband folded loop antenna, comprising:

a dielectric substrate;

a ground plane located on the dielectric substrate and having a grounding point;

a radiating portion comprising:

a supporter;

a loop strip having a length about a half-wavelength of the central frequency of the first resonant mode of the antenna, and having a feeding end and a grounding end, wherein the ground end is electrically connected to the grounding point of the ground plane, and the loop strip is folded into a three-dimensional structure and supported by the supporter; and at least one tuning patch electrically connected to the loop strip; and a matching circuit located on the dielectric substrate, and electrically connected at one terminal to the feeding end of the loop strip of the radiating portion and at another terminal to a signal source.

2. The multiband folded loop antenna of claim 1, wherein the dielectric substrate is a system circuit board of a mobile communication apparatus.

3. The multiband folded loop antenna of claim 1, wherein the ground plane is a system ground plane of a mobile communication apparatus.

4. The multiband folded loop antenna of claim 1, wherein the ground plane is formed on the dielectric substrate by printing or etching.

5. The multiband folded loop antenna of claim 1, wherein the material of the supporter is selected from the group consisting of air, a dielectric substrate, a plastic material, and a ceramic material.

6. The multiband folded loop antenna of claim 1, wherein the matching circuit comprises at least one capacitive element and at least one inductive element, and the capacitive element and the inductive element are connected in parallel.

7. A multiband folded loop antenna, comprising:

a dielectric substrate;

a ground plane located on the dielectric substrate and having a grounding point; and a radiating portion comprising:

a supporter;

a loop strip having a length about a half-wavelength of the central frequency of the first resonant mode of the antenna, and having a feeding end and a grounding end, wherein the feeding end is connected to a signal source, and the grounding end is electrically connected to the grounding point of the ground plane, and the loop strip is folded into a three-dimensional structure and supported by the supporter; and at least one tuning patch electrically connected to the loop strip.

8. The multiband folded loop antenna of claim 7, wherein the dielectric substrate is a system circuit board of a mobile communication apparatus.

9. The multiband folded loop antenna of claim 7, wherein the ground plane is a system ground plane of a mobile communication apparatus.

10. The multiband folded loop antenna of claim 7, wherein the ground plane is formed on the dielectric substrate by printing or etching.

11. The multiband folded loop antenna of claim 7, wherein the material of the supporter is selected from the group consisting of air, a dielectric substrate, a plastic material, and a ceramic material.

12. A multiband folded loop antenna, comprising:

a dielectric substrate;

a ground plane, located on the dielectric substrate and having a grounding point;

a radiating portion, comprising:

a loop strip, having a length about a half-wavelength of the central frequency of the first resonant mode of the antenna, and having a first U-shaped portion, a second U-shaped portion, a first connection portion, a second connection portion, a third connected portion, a feeding end and a grounding end, wherein the ground end is electrically connected to the grounding point of the ground plane, the first connection portion connects the first U-shaped portion to the feeding end, the second connection portion connects the first U-shaped portion to the second U-shaped portion, the third connected portion connects the second U-shaped portion to the grounding end, and the loop strip is folded into a three-dimensional structure.

13. The multiband folded loop antenna of claim 12, wherein the first U-shaped portion and the second U-shaped portion are on the same plane.

14. The multiband folded loop antenna of claim 13, wherein the first U-shaped portion has a first opening, the second U-shaped portion has a second opening, and the first opening and the second opening are toward opposite directions.

15. The multiband folded loop antenna of claim 12, wherein the radiating portion further comprises at least one tuning patch connected to the second connection portion.

* * * * *